United States Patent [19]

Vito et al.

[11] Patent Number: 4,531,286

[45] Date of Patent: Jul. 30, 1985

[54] CARTON CUTTING KNIFE

[76] Inventors: Raymond P. Vito, 2224 Riada Dr., NW., Atlanta, Ga. 30305; H. Russell Boehm, 205 Governor's Dr., Forest Park, Ga. 30050

[21] Appl. No.: 465,001

[22] Filed: Feb. 8, 1983

[51] Int. Cl.[3] ..... B67B 7/00; B26B 29/00

[52] U.S. Cl. ..... 30/2; 30/143; 30/151; 30/286; 30/317; 30/339

[58] Field of Search ..... 30/2, 77, 85, 86, 143, 30/115, 151, 164, 286, 317, 329, 339

[56] References Cited

U.S. PATENT DOCUMENTS

| | | | |
|---|---|---|---|
| 2,376,887 | 5/1945 | Walters | 30/286 |
| 2,694,856 | 11/1954 | Muros et al. | 30/86 X |
| 2,730,800 | 1/1956 | Bailey | 30/2 |
| 2,743,523 | 5/1956 | Honey | 30/2 |
| 3,178,812 | 4/1965 | Lurie | 30/2 |
| 3,204,338 | 9/1965 | Kruger | 30/85 X |
| 3,525,152 | 8/1970 | Fattori et al. | 30/2 |
| 3,641,667 | 2/1972 | Leopoldi | 30/2 |
| 3,781,988 | 1/1974 | Jones | 30/2 |
| 3,999,290 | 12/1976 | Wood | 30/20 |
| 4,086,698 | 5/1978 | Sparks | 30/2 |

*Primary Examiner*—Douglas D. Watts

*Attorney, Agent, or Firm*—Newton, Hopkins & Ormsby

[57] ABSTRACT

A knife particularly for opening corrugated board cartons efficiently and safely without damaging the carton contents includes a forward end receptor slot for a standard single edge razor blade which positions the cutting edge of the blade below and forwardly of the hand grip portion of the knife for safety. An automatically retractable and recloseable blade guard having a cantilevered connection with the hand grip portion of the knife also serves as a cover for a blade storage compartment in the hand grip portion and is permanently attached to the knife to preclude loss. Depth of cut is limited to avoid damaging carton contents.

2 Claims, 11 Drawing Figures

CARTON CUTTING KNIFE

BACKGROUND OF THE INVENTION

The object of this invention is to satisfy an acknowledged need for a better carton opening knife, in terms of safety and convenience of use and avoiding damage to the contents of cartons during the cutting process.

Among the recognized deficiencies of known prior art knives for this purpose are that they sometimes cut too deeply and damage the contents of cartons in the opening process. The knives in some cases are too small and are constructed so as to be difficult and uncomfortable to hold in the hand. They can also be easily lost. Being formed primarily of metal, the knives tend to corrode and rust.

Another difficulty is that the movable blade guard, if provided at all, is not automatic, and users frequently overlook moving it to the guarding position with the result that the user or his clothing can be cut.

Some prior art knives require the use of a special blade rather than a standard blade, thus increasing cost.

In accordance with the present invention, these and other prior art deficiencies are completely overcome. A carton opening knife is provided which does not have any parts requiring conscious manual movement prior to use. The knife accepts standard safety razor blades. It is safe in that a blade guard or shield springs into place over the blade automatically whenever the knife is not in use. The blade guard retracts automatically whenever the knife is being used. The knife is simple and economical in construction, is convenient and comfortable to grip, resists corrosion in a wet environment, being formed of one piece plastic construction, and includes efficient storage space for spare blades. The blade guard or shield is permanently hinged to the hand grip through a strip which serves as a cover for the blade storage compartment and also forms a cantilever spring for the guard and carries a snap fastener which secures the guard in its operative position.

Other features and advantages of the invention will become apparent during the course of the following description.

DETAILED DESCRIPTION

Figure 5:
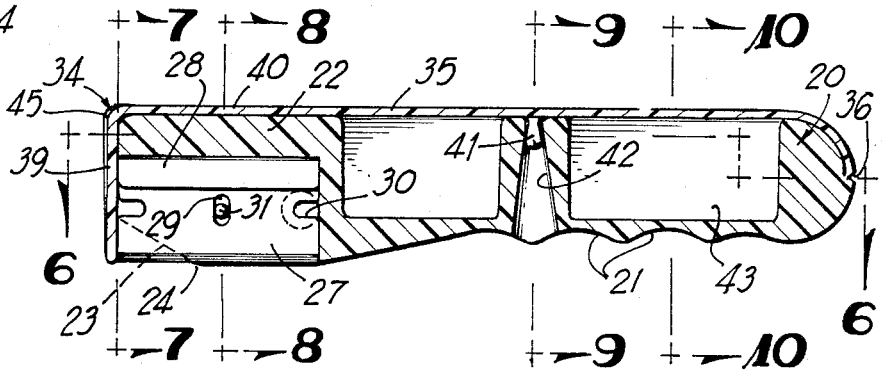
FIG. 5 is a longitudinal vertical section through the knife as depicted in FIG. 1.
Figure 6:
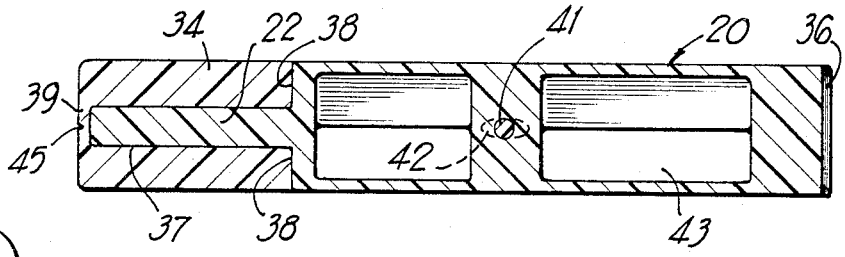
FIG. 6 is a horizontal section taken on line 6—6 of FIG. 5.
Figure 9:
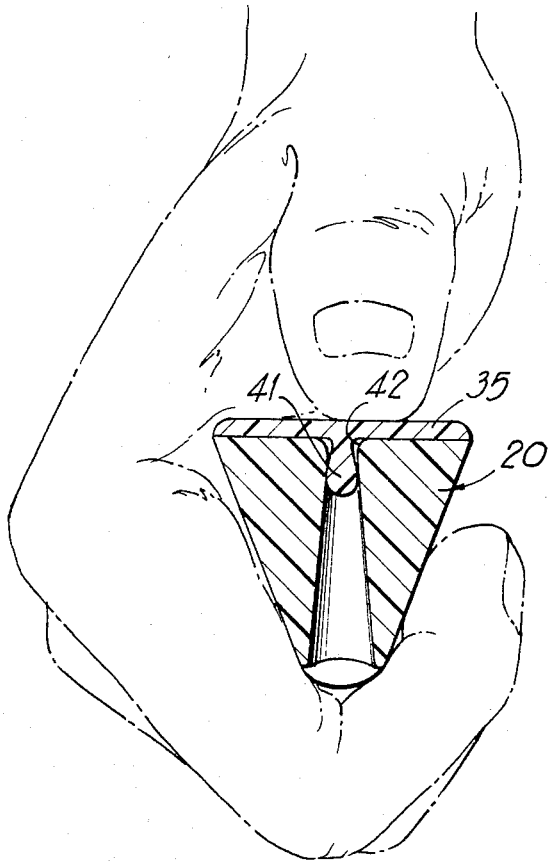
FIG. 9 is a similar section taken on line 9—9 of FIG. 5.

Referring to the drawings in detail wherein like numerals designate like parts, a knife for opening corrugated board cartons or for similar purposes comprises a hand grip portion 20 of adequate length to fit comfortably and stably in one hand of a user. The hand grip portion 20 is of modified triangular cross section with rounded corners and with the apex of the isosceles triangle facing downwardly in the hand during use as shown in FIG. 9, whereby the hand grip can be wedged strongly and snugly into the fingers while thumb pressure is exerted on the flat top face of the knife. As best shown in FIG. 5, the lower margin of the hand grip portion 20 is provided with accurate finger rests 21 for further comfort and stability.

At the forward end of the hand grip 20, a reduced width blade mounting extension 22 is provided integral with the hand grip portion 20 at the transverse center of the latter. The blade mounting extension 22 has a generally rectangular side profile, FIGS. 2 and 3, and has its forward lower corner cut away at an angle to form an inclined face 23 which limits the depth of cut by the knife and a rocker point or shoulder 24 at the rear of the face 23 by means of which the depth of cut can be regulated as shown in FIG. 4.

Figure 4:
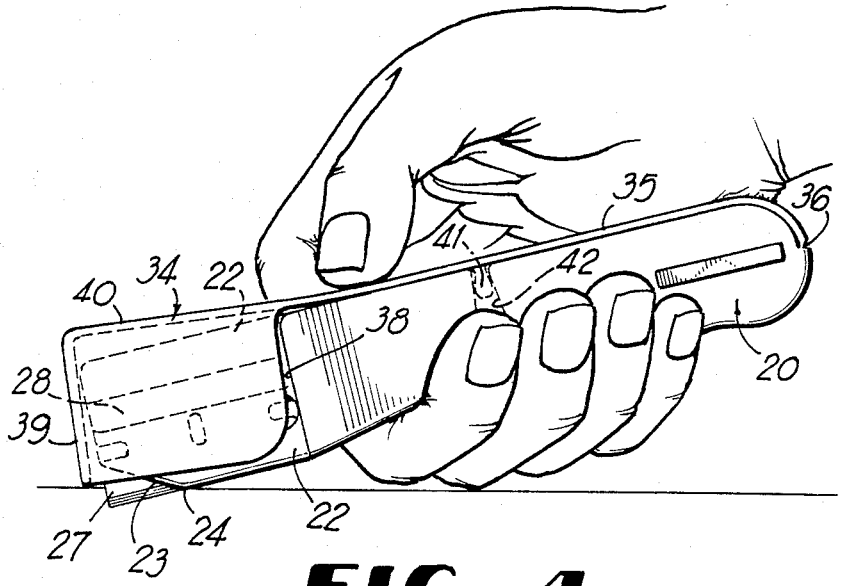
FIG. 4 is a side elevation of a knife depicting its normal usage for opening a carton.

The blade mounting extension 22 and hence the cutting edge of the blade is placed not only forwardly of the area in which the fingers are located during use, but also somewhat below the lower margin of the hand grip portion and fingers, for the sake of safety, and to facilitate the use of the knife, as best shown in FIG. 4.

The blade mounting extension 22 has a center longitudinal slot 25 opening through its forward end and bottom, and this slot has an upper portion 26 of increased width as shown in the drawings.

A standard single edge razor blade 27 forms the knife cutting blade and the thick rigid reinforcing rib 28 of this blade is received slidably in the slot portion 26 while the blade body enters the narrow slot 25.

The standard blade includes a center aperture 29 and opposite end slots 30. The divided side walls of blade mounting extension 22 each have half-round detents 31 formed thereon which may separate by spring action when the blade enters the slot 25 and then snapped lockingly into the blade aperture 29 to lock the blade securely in place on the extension 22.

In such use position, the forward lower corner of the razor blade 27 projects outwardly from the inclined face 23 forwardly of the fulcrum point 24. The remainder of the blade is enclosed by the extension 22.

Figure 2:
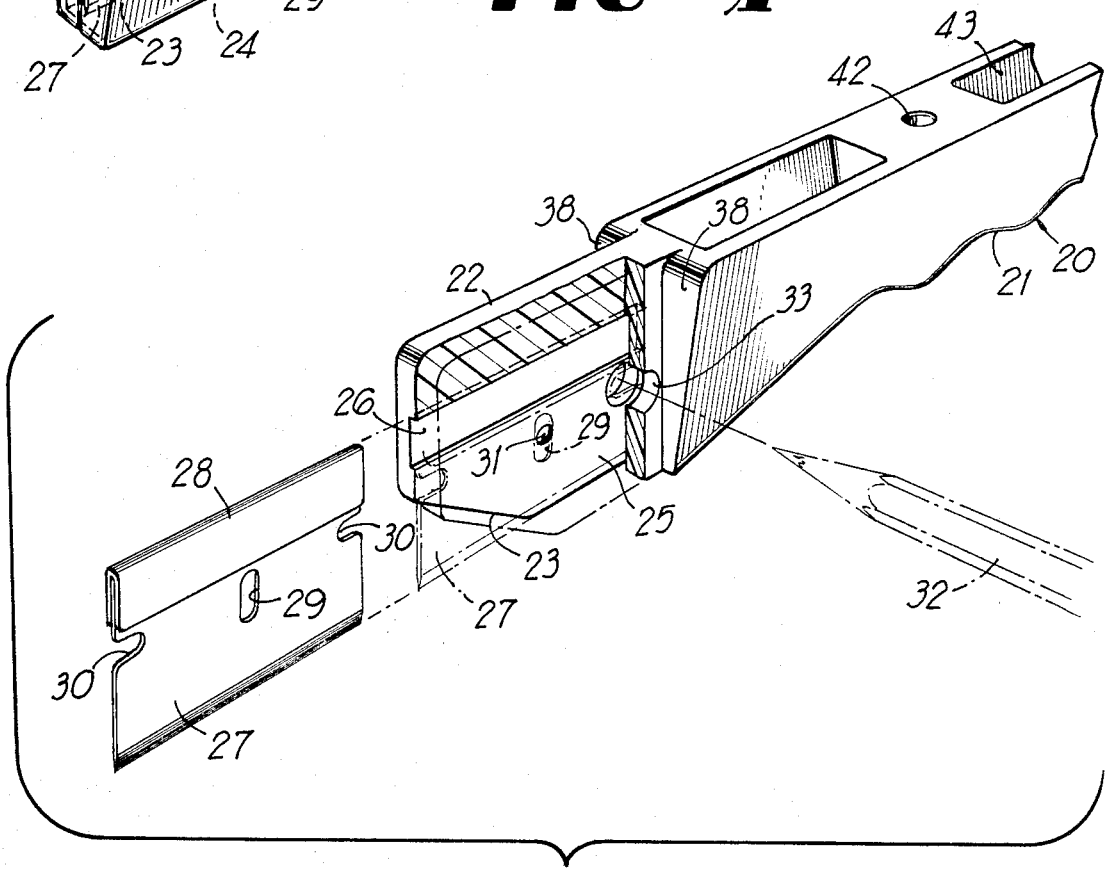
FIG. 2 is an exploded perspective view of the forward portion of the knife, partly in section, showing the mounting of a standard replaceable razor blade.

To remove the blade 27 at proper times from the mounting extension 22, or replacement by a new blade, a pencil 32 or the like, FIG. 2, can be inserted through a provided transverse opening 33 at the rear of extension 22 which registers with one blade slot 30. Pressure exerted by the pencil on the blade 27 in this manner can overcome the action of detent means 31 and dislodge the blade from the extension 22 without difficulty.

It may be seen, particularly in FIG. 4, that the arrangement of the inclined face 23 and fulcrum 24 enables the depth of cut by the blade to be finely controlled by the user, and the maximum depth of cut is limited by the extent of projection of the blade corner beyond the face 23. Also the cutting portion of the blade 27 is always well ahead of and below the fingers grasping the hand grip 20.

Figure 7:
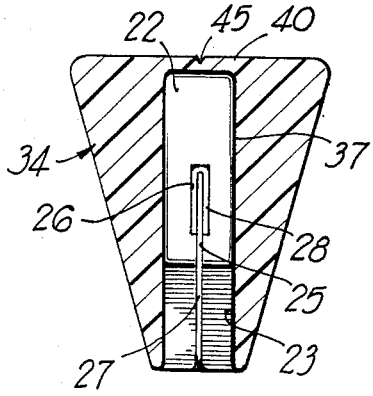
FIG. 7 is an enlarged transverse vertical section taken on line 7—7 of FIG. 5.
Figure 8:
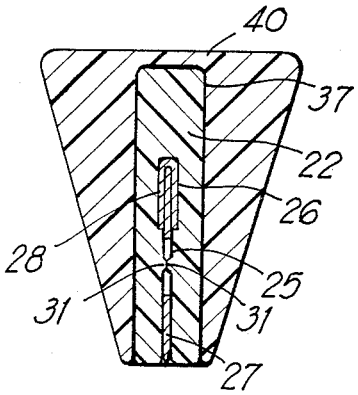
FIG. 8 is a similar section taken on line 8—8 of FIG. 5.

A very important and unique feature of the knife resides in the provision of a blade guard 34 integrally formed with an elongated flexible attachment strip 35 whose rear end is permanently attached to the rear of the hand grip 20 through a transverse axis living hinge 36. The blade guard 34 has a downwardly open cavity 37 between its side walls which snugly receives the entire mounting extension 22 when the guard is in the full down or guarding position as shown in FIGS. 5, 7 and 8. The rear side of the guard 34 is also open adjacent to transverse shoulders 38 at the front of the hand grip 20. The guard has a comparatively thin front wall 39 and a similarly thin top wall 40 above the cavity 37. The two side walls of the guard 34 are thick and downwardly tapering, as shown, to match the modified triangular cross sectional shape of the hand grip portion 20.

Near its longitudinal center, the strip 35 carries on its lower side a snap fastener element 41 adapted to engage in a retaining aperture 42 formed in the top face of hand grip 20 substantially rearwardly of blade mounting extension 22. When engaged in the aperture 42, the snap fastener element 41 retains the flexible strip 35 secured flat against the top face of hand grip portion 20, it being noted that the strip 35 is of the same width as the wide top face of the hand grip portion and also of the same width as the top wall 40 of the blade guard 34, in effect, forming a continuation of the latter.

Figure 1:
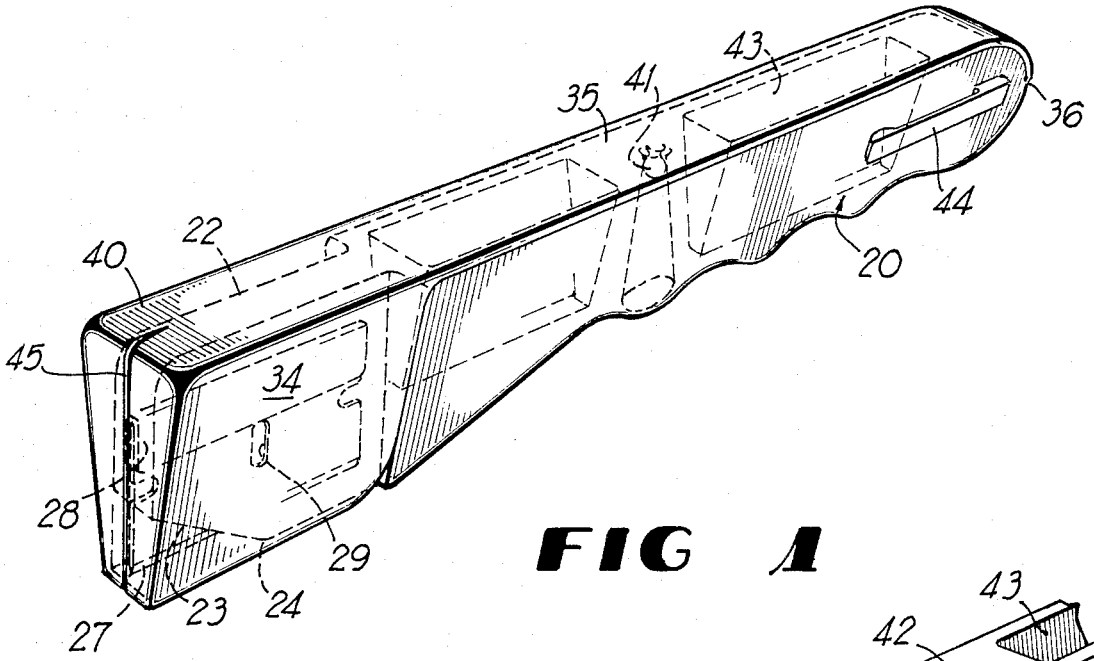
FIG. 1 is a perspective view of a carton cutting knife according to the invention with the blade guard in its normal active position.

Forwardly of the fastener element 41, the flexible strip 35 and guard are unattached to the hand grip and blade mounting extension 22. Consequently, when the knife is used as depicted in FIG. 4, with the thumb pressing on the strip 35 somewhat rearwardly of the guard 34, a cantilever spring support for the blade guard is created. Thus, during the carton cutting operation the guard will contact the surface being cut and will yield and retract automatically from the blade 27 and extension 22 sufficiently to allow the desired depth of cut to take place safely. As soon as the knife is lifted from the carton, the guard 34 will return automatically by spring tension to the full blade guarding position shown in FIGS. 1 and 5 where no part of the blade cutting edge is exposed.

Figure 10:
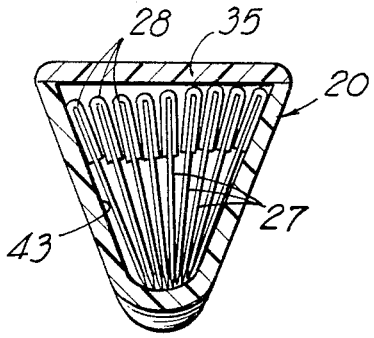
FIG. 10 is a similar section taken on line 10—10 of FIG. 5.
Figure 11:
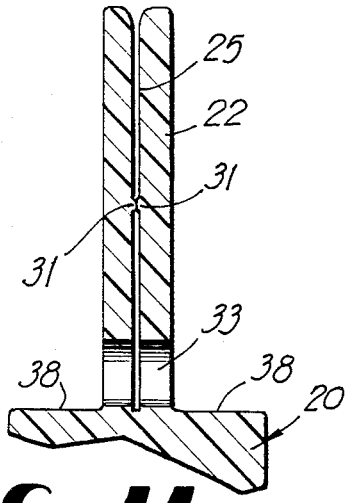
FIG. 11 is an enlarged fragmentary section taken on line 11—11 of FIG. 3.

As shown in the drawings, the hand grip portion 20 rearwardly of snap fastener 41 has a wedge-shaped spare blade compartment 43 adapted to efficiently contain a number of the blades 27 with their thick ribs 28 disposed upwardly in the wide portion of the storage compartment. The top of this storage compartment is open and the guard extension strip 35 serves the additional purpose of covering or closing the compartment 43, as shown in FIG. 10.

Figure 3:
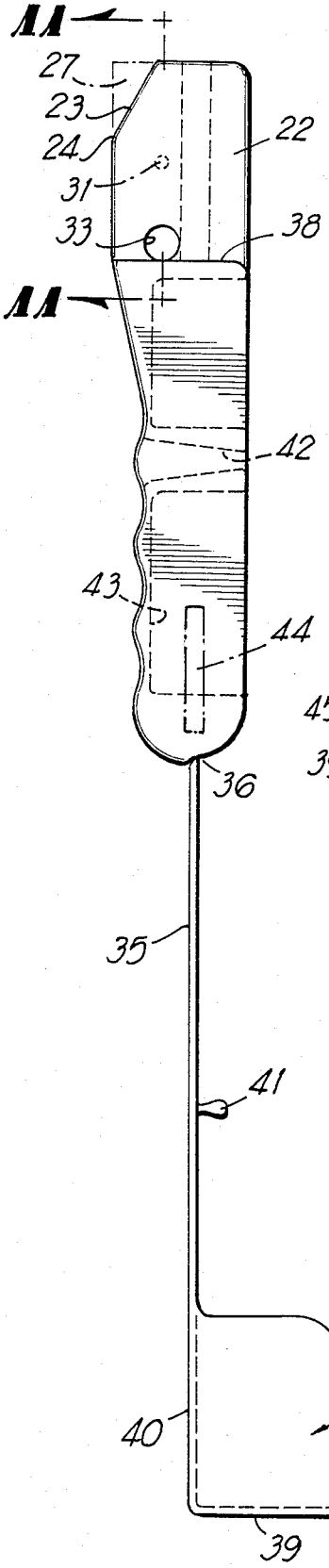
FIG. 3 is a side elevation of a knife with the guard for the blade in the open or inactive position.

Since the strip 35 is permanently hinged to the hand grip 20, there is no possibility of it separating or becoming lost. Neither is there any likelihood of the safety guard not being used during the operation of the knife because its action of exposing and then covering the blade 27 is essentially automatic when the knife is being held in the hand, and it is unnecessary for the user to exert any conscious forces or movements on the guard. The user will always place the strip 35 and guard in the position shown in FIG. 4 when using the knife, because otherwise the spare blades would fall out and it would be most awkward to use the knife as shown in FIG. 3 with the strip 35 trailing the hand grip.

It is believed that the several important advantages of the invention over the prior art have now been described, so that the merits of the invention will be readily apparent to those skilled in the art.

It should be mentioned that in lieu of carrying the knife in one's pocket during periods of non-use, a belt attachment clip 44 can be provided on one side of the hand grip 20 near its rear end. As shown and described, the device is particularly adapted to be molded from plastics material, and would come from the mold in the form shown in FIG. 3.

Another favorable feature which can be embodied in the knife to assist in cutting in a straight line is the provision in the upper leading corner of the guard 34 of a small sighting groove 45, whereby the user of the knife can establish and maintain a "sight line".

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A one-piece molded plastics knife for opening cartons and the like comprising an elongated hand grip portion for grasping by one hand of a user, a blade mounting extension on the forward end of the hand grip portion and having a blade receptor slot formed therein and opening through the front and bottom side of the blade mounting extension, said blade receptor slot having yielding opposite side detent elements to releasably lock a standard single edge cutting blade within the blade receptor slot, the forward lower portion of said blade mounting extension being formed on an angle to the longitudinal axis of the knife to expose the leading corner of a cutting blade held within the blade receptor slot, the top faces of said hand grip portion and blade mounting extension defining a common substantially flat surface longitudinally of the knife, the hand grip portion having a blade storage compartment formed therein and opening through said common flat surface, a combined blade guard and cover for the blade storage compartment including a thin flexible strip having its rear end joined to the rear end of the hand grip portion by a living hinge and extending forwardly longitudinally for substantially the entire length of the knife and being in covering relationship to the blade storage compartment, depending front and side walls on said strip adjacent to said cutting blade mounting extension whereby said side walls can closely straddle the cutting blade mounting extension and said front wall can lie substantially in contact with the forward end of the cutting blade mounting extension while such strip is essentially flat and in contact with said common flat surface, said front and side walls then forming a guard for the exposed corner of a cutting blade held within said blade receptor slot, a snap fastener element on the bottom of said strip forwardly of said blade storage compartment, said hand grip portion having a snap fastener receptor opening in its top face adapted to receive the snap fastener element, whereby thumb pressure applied against the top of said strip somewhat rearwardly of the cutting blade mounting extension enables the strip to function as a cantilever support spring for said guard so that the guard will yield and retract automatically in response to engagement with a surface being cut and will return automatically by spring tension to a blade guarding position following separation of the guard from the surface being cut.

2. A one-piece molded plastics knife for opening cartons and the like as defined in claim 1, and said hand grip portion being approximately triangular in cross section with the apex of the triangle disposed downwardly to facilitate gripping by the fingers of the hand of a user, said blade mounting extension being of reduced width compared to the hand grip portion and having substantially flat parallel sides, and said blade guard defined by said front and side walls having approximately the same exterior cross-sectional shape as the hand grip portion and defining a substantially rectangular cross section slot snugly receiving the blade mounting extension therein.

* * * * *